United States Patent [19]

Menini

[11] 4,074,531

[45] Feb. 21, 1978

[54] OLEODYNAMIC SERVO CONTROL

[75] Inventor: Corrado Menini, Bologna, Italy

[73] Assignee: Lamborghini Oleodinamica S.p.A., Bologna, Italy

[21] Appl. No.: 720,428

[22] Filed: Sept. 3, 1976

Related U.S. Application Data

[63] Continuation of Ser. No. 449,472, March 8, 1974, abandoned.

[51] Int. Cl.[2] ..... F15B 3/00

[52] U.S. Cl. ..... 60/547; 60/567; 60/571; 60/594; 91/378

[58] Field of Search ..... 91/372, 373, 377, 378, 91/422, 465; 137/596; 60/551, 547, 581, 567, 553, 552, 571, 594

[56] References Cited

U.S. PATENT DOCUMENTS

| | | | |
|---|---|---|---|
| 2,142,628 | 1/1939 | Ballert | 91/465 X |
| 2,189,013 | 2/1940 | Loweke | 60/567 |
| 2,360,578 | 10/1944 | Porter | 60/553 |
| 2,410,269 | 10/1946 | Chouings | 60/553 |
| 2,775,957 | 1/1957 | Anderson | 91/378 X |
| 2,902,829 | 9/1959 | Verbrugge | 60/553 X |
| 2,946,195 | 7/1960 | Hare | 60/553 X |
| 3,099,289 | 7/1963 | Neilson et al. | 92/131 X |
| 3,099,940 | 8/1963 | Leduc | 91/378 X |
| 3,345,817 | 10/1967 | Randol | 60/552 X |
| 3,894,390 | 7/1975 | Belart et al. | 60/552 |
| 3,899,890 | 8/1975 | Adams | 60/552 |
| 3,961,561 | 6/1976 | Knutson | 91/378 |

*Primary Examiner*—Irwin C. Cohen
*Attorney, Agent, or Firm*—Montague & Ross

[57] ABSTRACT

A load-controlling piston of the double-action type, dividing an associated cylinder into two compartments, is positionable by a hydraulic servomechanism comprising a block wherein a high-pressure supply port and a low-pressure discharge port communicate with a pair of pressure cylinders occupied by respective plungers which are hydrostatically linked with the piston through conduits connecting the compartments of the piston cylinder with respective pressure chambers of variable volume formed by the two pressure cylinders. Each plunger has an axial bore accommodating a valve stem with a tapering head which is surrounded with small clearance by a valve chamber communicating at one end with the discharge port and at the opposite end via an internal passage with a gap adjacent a plunger face remote from the corresponding pressure chamber. In a normal plunger position the valve chamber is disconnected from the supply port by the retracted valve head; upon displacement of the valve stem by an actuating lever common to both plungers, against a restoring spring force, the valve head enters the valve chamber and defines therewith two constrictions tending to hold that head in an equilibrium position whereby the plunger follows the movement of the valve stem and in turn displaces the piston into a position uniquely associated with that of the plunger.

4 Claims, 2 Drawing Figures

OLEODYNAMIC SERVO CONTROL

Figure 1:
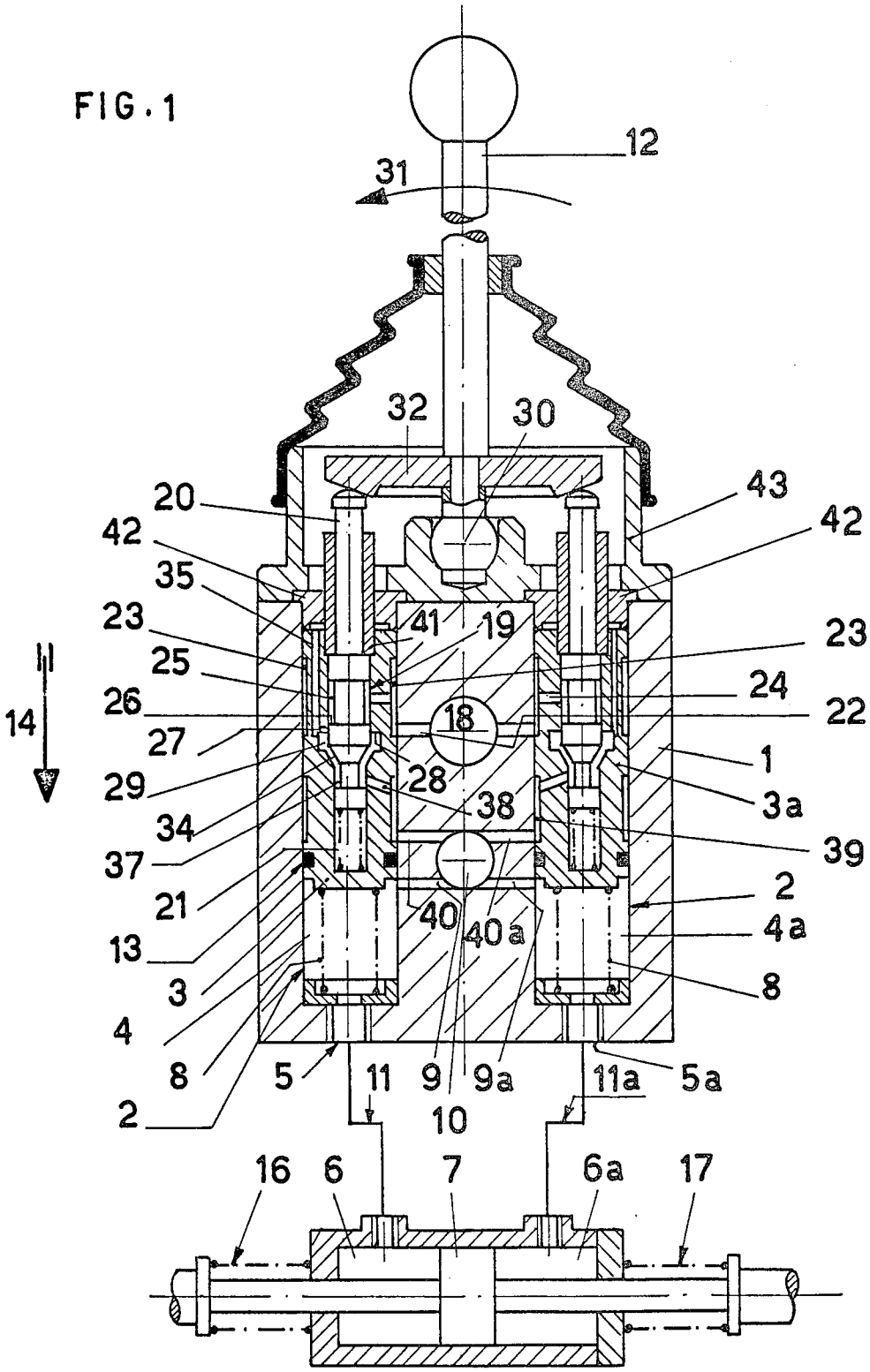

This is a continuation of application Ser. No. 449,472, filed 8 Mar. 1974 now abandoned.

The present invention relates to improvements in remote gradual oleodynamic servo controls.

It is an object of the present invention to provide a remote gradual servo-control adapted to produce with reduced manual force a gradual displacement of a drive piston actuated by the servo control and with the sole connection between the servo control and the piston of a thin tube of any length.

The present invention is especially adapted to servo controls for actuating the rods of directional valves (or distributors) for oleodynamic systems.

Other servo controls are known which achieve this purpose, their operating principle being based exclusively on varying the pressure of the fluid which acts on the drive piston controlled.

More precisely, if it is borne in mind that the entire servo control is formed of a true lever-control device and of a drive piston located at a distance, which are connected to each other by a tube and if it is taken into account that the servo control device is for the purpose of gradually modifying with reduced manual force, the position of the drive piston for every position of the control lever, the devices known up to the present time obtain such gradual action by varying, with the displacement of the conrol lever, the pressure which acts on the drive piston so that the maximum pressure available on the drive piston corresponds to the maximum stroke of the control lever.

The gradual control of the known systems based on the reduction of pressure responds to a good operation in theory, but in practice functional defects which are very important are found.

As a matter of fact, only by permitting that the resistance to the drive piston to increase linearly (opposition of a spring) is there is a corresponding graduality of position in the control lever which controls the pressure, while on the other hand, in practice, it is known that even solely as a result of the variations of friction, such gradual nature cannot be obtained. Not only this, but if there is employed a two-stroke control with an intermediate half, then necessarily at the start of the second stroke the friction of the initial movement of the drive piston requires in that position a force far greater than that necessary when the piston is in the same position but moving; therefore the control lever whose position regulates the pressure will never have a position which corresponds precisely to the said position of the drive piston.

Still another defect in the known systems is that at the end of the forward stroke of the control lever the maximum pressure is available for obtaining the maximum stroke of the drive piston which, being at the end of its stroke, stops. In order to bring about the return of the drive piston, one effects the return of the lever which controls the pressure of the servo control, but before the drive piston starts its return stroke, it is necessary that the pressure on said piston be reduced, at least by the amount corresponding to the initial starting friction which in this case acts as brake, because only after a substantial angle of return displacement of the control lever does the return of the drive piston commence, namely there is a difference in phase between the position of the control lever and the position of the drive piston, which phase difference is directly reversed with the reversal of the movement.

Another important consideration with regard to defects of the systems used up to the present time which are based on the reduction of pressure refers especially to the specific use of the servo control to control distributors for oleodynamic systems.

As a matter of fact, in this specific use, the drive piston controls the translation of the shaft which opens and closes the fluid-passage valves in the servo-controlled distributor.

Now, as it is known that during the opening and the closing of a stream to fluid the dynamic actions of said fluid act on the switching shaft to such an extent as to create substantial forces which add on to or are subtracted from the force normally necessary for the translation of the rod, it is obvious that such forces disturb the uniformity of the gradual nature of the servo control. As a matter of fact, by proceeding slowly with the lever which controls the servo control, as already stated, in the known systems, there is caused a gradual increase of the pressure in the drive piston and therefore the gradual displacement thereof in equilibrium with the increasing resistant force; however, if during the said displacement a force within the servo-controlled distributor suddenly comes to assist the displacement of the rod, namely instantaneously decreases the resistant force, the effect is a forward jump of the drive piston as compared with the lever of the servo control; therefore, the gradualness of displacement of the drive piston does not correspond to the gradualness of the lever of the servo control.

The disadvantages of the known systems were exemplified above in order better to show the improvement obtained with the system of the present invention, which system, although also utilizing this variation in pressure, does not condition the positioning of the drive piston on the variations of pressures, but rather on a combined system of oleodynamic positioning on the side of the servo control and of a volumetric hydrostatic transmission between the servo control and the drive piston. With the combination of the two principles-volumetric hydrostatic transmission and oleodynamic positioning of the servo control, the present invention achieves the purpose of making the individual positions of the drive piston absolutely independent from the pressure.

As a matter of fact, the present new arrangement splits the means which serves to transmit the movement between the servo control and the drive piston (using the passage of a constant volume of fluid between two pistons, one placed in the servo control, while the other is the drive piston assuring the positioning in absolute direction) from the other means, which serves automatically to regulate the pressure and therefore the force in any position assumed by the drive piston. The two means have two entirely different functional purposes which do not interfere with each other during the use of the servo control; specifically, the movement of the lever of the servo control establishes the positioning of the drive piston and not the variation of pressure necessary, the pressure necessary is in its turn self-regulated by the resistant force of the drive piston without this requiring variations in positioning of the lever of the servo control.

Figure 2:
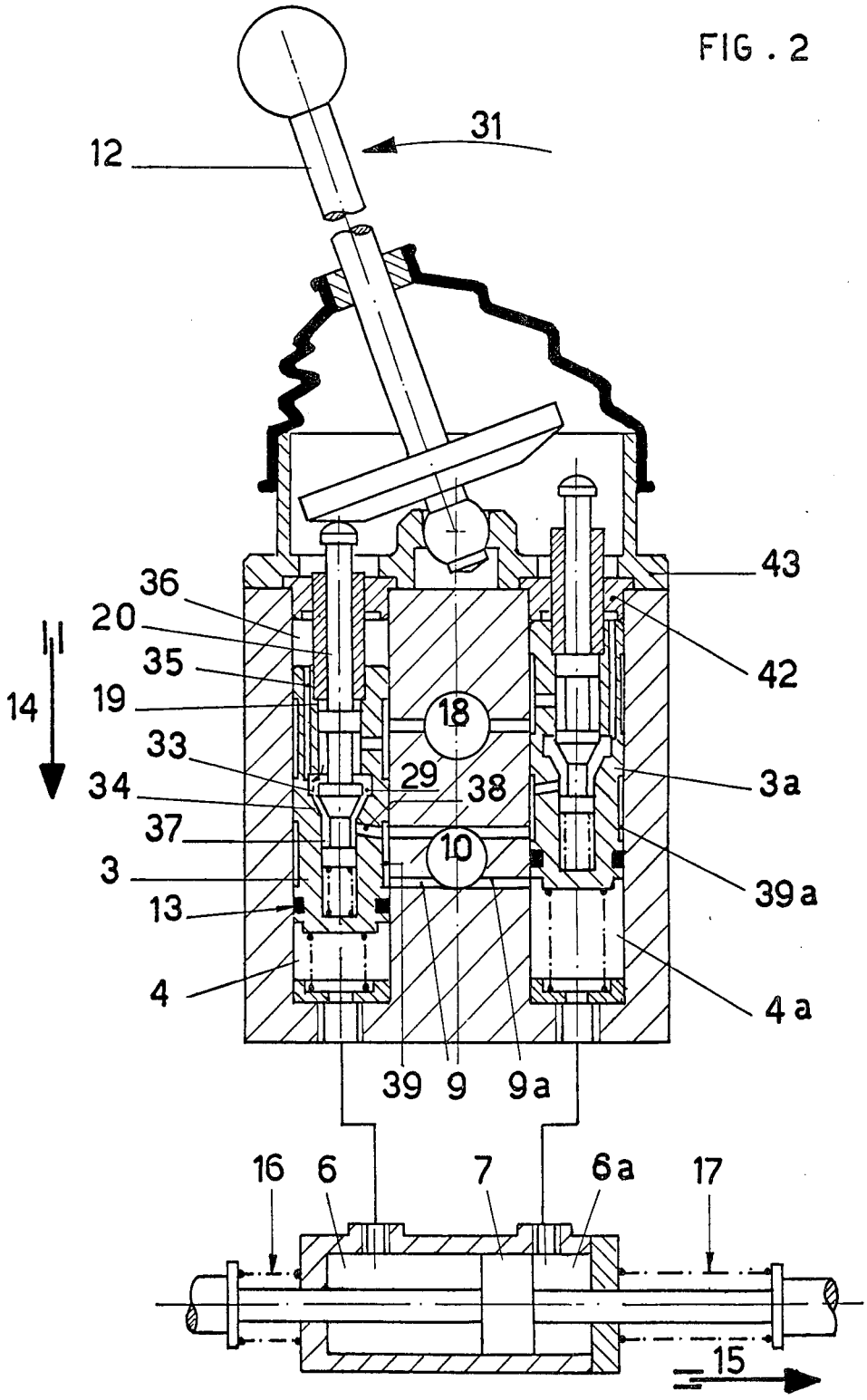

With the above and other objects in view, which will become apparent in the following detailed description, the present invention will be clearly understood in connection with the accompanying drawings, in which:

FIG. 1 is a longitudinal cross-section through the servo control at rest with the drive piston connected; and FIG. 2 is a longitudinal cross-section through the servo control with the lever in a mid-stroke position.

Referring now to the drawings, and more particularly to FIG. 1, the servo control in accordance with the present invention is formed of a body 1 in which there are provided two or more cylindrical housings 2. In the housings 2 there are arranged for sliding, two pistons 3 and 3*a*. The height of the pistons 3 being much less than the height of the housing 2, there are created chambers 4 and 4*a* in the lower part of the housings 2. The chambers 4 and 4*a* are in communication through the threaded holes 5 and 5*a* with the chambers 6 and 6*a* of the drive piston 7. The communication between the discharge holes 5 and 5*a* of the servo control and the chambers 6 and 6*a* is obtained by means of tubes of any length. In the position of rest, the drive piston 7 is in the center of its operating stroke and the pistons 3 of the servo control are in their topmost position, urged by the springs 8.

The pistons 3 in their upper position rest against the covers 42 which also have the function of tightly closing the housings 2. The covers 42, which are held in place by the main cover 43, have a central hole in which there slides the extension 41 of the piston 3 which in its turn surrounds the extension of a small piston 20.

The extension of the small piston 20 also represents the abutment for the arm 32 of the square drive lever 12 pivoted at 30.

The feed system of the servo control is assured by a pump, not shown, which supplies the necessary fluid at a pressure limited by a maximum-value valve.

This value of pressure is pre-established so as definitely to overcome the maximum points of force encountered by the drive piston 7 at any point of its stroke.

The pump feeds the servo control in the hole 18 (FIGS. 1 – 2) and therefore the fluid in the hole is at the maximum pressure which has been pre-established, while the hole 10 (FIGS. 1 – 2) is in communication with the discharge of the fluid downstream of the maximum pressure valve in the conduit which extends to the fluid tank and therefore the pressure in the hole 10 has a minimum value of a few atmospheres greater than zero.

Small holes 9 and 9*a* feed the fluid from the discharge 10 which, after the purging of the air, will fill up the chamber 4 and the tube 11 and the chambers 6 and 6*a*.

The above-described constitutes the hydrostatic part of the servo control and the means which determines the positioning of the drive piston corresponding perfectly to the positioning of the piston 3 and therefore to the lever 12 of the servo control, as will become evident from the following description.

As a matter of fact, neglecting for the time being the oleodynamic means which causes the lowering in the direction 14 of the piston 3 (FIG. 2), it can be noted that the piston 3 being provided at its lower end with a packing 13, when the packing has moved past the feed hole 9, any further displacement of the piston 3 in the direction 14 causes a decrease in the volume of the chamber 4 and therefore a passage of a volume of fluid from the chamber 4 to the chamber 6 corresponding to the decreased volume of the chamber 4.

In view of the fact that liquids are for all practical purposes noncompressible, every decrease in volume of the chamber 4 corresponds to an increase by the same volume of the chamber 6, and therefore to each position in the direction 14 of the piston 3 there corresponds a precise position of the drive piston 7 which has moved by virtue of the increased volume of the chamber 6 (FIG. 2).

Naturally, as the drive piston 7 moves in the direction 15, the chamber 6*a* is reduced in volume and therefore transmits an equal volume of liquid to the chamber 4*a* (FIG. 2); said volume of liquid is discharged through the hole 9*a* (FIG. 2) into the hole 10, since the chamber 4*a* is at its maximum volume, the piston 3*a* being stopped in the extreme upward position, and therefore the hole 9*a* being uncovered, it is free to cause the liquid to flow to the discharge 10, as has been stated.

Naturally, what has been described as the positioning of the piston 3 and of the drive piston 7 in the direction 15 as shown in FIG. 2 applies also when, upon displacing the lever 12 in the direction opposite that shown in FIG. 2, there is brought about the lowering of the piston 3*a* and therefore the displacement of the drive piston 7 in the direction opposite to 15. The return of the drive piston 7 to the center which is assured by the springs 16 and 17 takes place by operating the lever 12 which also is returned to the center, as shown in FIG. 1.

The filling of the chambers 6 – 6*a* and 4 – 4*a* is always assured by the holes 9 and 9*a;* as a matter of fact, noting FIG. 2 and considering the lever 12 returned to the center, there is produced the lifting of the piston 3 in the direction opposite to 14; with this, the chamber 4 increases in volume, permitting the fluid of the chamber 6 to flow into the chamber 4 through the tubing 11.

Simultaneously with this operation, which results in a decrease in the volume of the chamber 6, there logically takes place an increase in volume of the chamber 6*a* and therefore a call for fluid. This fluid is supplied by the discharge 10 through the hole 9*a*, the chamber 4*a* and the tubing 11*a;* this supplying of fluid is possible, since the piston 3*a* has remained stopped in its upper position during the return of the piston 3. At the moment of the return to the center of the lever 12 and therefore of the return upward of the piston 3 during the last portion of the stroke, the hole 9 is uncovered which will feed the filling of the chamber 4 if small blow-bys have taken place in the piston 7 or in the packing 13.

As has been stated, the operation of the means which serves exclusively for the positioning of the piston 7 is based on a transfer of a volume of fluid between chambers 4 and 4*a* and chambers 6 and 6*a* with the guarantee of constant filling of said chambers due to the supplying of fluid through the small holes 9 and 9*a* in communication with the hole 10 in which, as already described, the discharge fluid is present under a slight pressure.

Considering now the oleodynamic means which causes the lowering of the pistons 3 and 3*a*, it will be noted that the pressure for these movements will not be controlled by the positions of the lever 12 but will result from an automatic pressure regulation for each position assumed by the pistons 3 and 3*a*. This takes place in the following manner: each piston 3 is provided with a central hole 19 in which the small piston 20 can normally slide; when the lever 12 is at rest (FIG. 1) it is pushed upward by a spring 21 which holds the said small piston 20 firm against the abutment 41 forming part of the piston 3.

The small piston 20 being for all practical purposes a distribution box for the fluid fed through the hole 18, there will be seen hereinbelow the condition of said feed at the said moment of rest (FIG. 1). The fluid under pressure flows from the hole 18 through the small hole 22 of the body 1 into a circular chamber *e''* created by the housing 2 and by a portion of smaller diameter of the piston 3; from the chamber 23 the fluid flows through a small hole 24 to a chamber 25 created by the hole 19 and by a portion of smaller diameter of the small piston 20.

The chamber 25 has practically no outlet path when the small piston 20 is in the position of rest.

As a matter of fact, the lower edge 26 of the chamber 25 covers over a small distance 27 the upper corner 28 of a chamber 29 formed of a section of a diameter greater than the diameter of the hole 19.

The covering 27 closes off any escape for the fluid and therefore at rest a zone of leveled maximum pressure remains as value in the chambers and conduits 18 - 22 - 23 - 24 - 25.

This maximum pressure in phase of rest does not give rise to any effect since the piston 20 in its chamber 25 is perfectly balanced in the surfaces subjected to pressure. By actuating the control lever 12 (FIG. 1) which is pivoted at 30 in the direction 31 there will be obtained, via the arm 32, the urging of the piston 20 to move in the direction 14 (FIGS. 1 - 2). In the very first phase of the downward movement of the piston 20 there will be obtained the elimination of the covering 27 (FIG. 1) and therefore the opening of the passage 33 (FIG. 2). This takes place because the resistance of the spring 21 is much less than the spring 8 which holds the piston 3 stationary in upward position (FIG. 1). As soon as the passage 33 has been established, the fluid under pressure in the chamber 25 will start to flow into the chamber 29. The chamber 29 has two communications - a lower one through a seat 34 (FIG. 2) normally open in stage of rest but which may be closed by the piston 20 on its maximum displacement in the direction 14, and another upper one through the hole 35 which connects with the upper part of the piston 3 and which can feed fluid to the chamber 26 which is created upon the lowering of the piston 3 (FIG. 2).

While the fluid which escapes from the passage 34 reaches the discharge 10 through the chamber 37, the hole 38, the chamber 39 and the hole 40, the fluid which flows through the hole 35 serves to cause the lowering of the piston 3, causing an increase in volume of the chamber 36.

As stated previously, the pre-established condition for the good self-regulating operation of the pressure necessary in each positioning is that the constant maximum pressure in the feed hole 18 be sufficient, with a margin of safety, to overcome the maximum force opposed by the drive piston 7. For all other values of pressure less than the maximum force, the device will automatically establish the equilibrium pressure necessary in that given position; not only this, but for a given position upon variation of the resistance values it will vary the pressure necessary without the position undergoing appreciable changes.

This takes place in the following manner: in the position of rest shown in FIG. 1, the chambers **4 - 4*a* and 6 - 6*a* and the corresponding tubings 11 and 11*a*** fill up with static fluid which, as we have described, has the value of the discharge pressure of slightly more than zero.

Still in the position of rest, there is a zone of fluid under maximum pressure limited to the central hole 18, the small hole 22, the chamber 23, the hole 24 and the chamber 25: this fluid under maximum pressure is also static, the chamber 25 not having any open outlet.

Still in the position of rest of the chamber 29, there is static fluid at the minimum discharge pressure, the chamber 29 being in communication with the discharge 10 through the passages 34 - 37 - 38 - 39 - 40 (FIG. 1).

Imagine now that the lever 12 is moved in the direction 31 to bring it into the intermediate position shown in FIG. 2. As has been stated, the first immediate effect is to lower only piston 20, establishing the opening and the passage 33; in this way the fluid under static maximum pressure in the chamber 25 will escape into the chamber 29 and from there, via the seat 34, will reach the discharge 10 flowing from 37 - 38 - 39 - 40.

Naturally the fluid passing from static condition to dynamic condition will lose, on its path from 18 to 10, its pressure which will charge from the maximum value at 18 to the minimum value at 10. In the chamber 29, it is clear, there will, however, be established a pressure of reverse value, namely at the minimum opening of the passage 33 (FIG. 2); said passage being extremely small, there will be an immediate large loss of load, and therefore in the chamber 29 a minimum pressure which will gradually increase as the passage 33 increases its opening with the lowering of the small piston 20. However, the gradual opening of the passage 33 coincides with the gradual closing of the passage 34 and, at the limit, when the passage 34 is closed, there is the same maximum pressure in the chamber 29 as in the hole 18.

There is thus the possibility, with the lowering of the piston 20, of having every value of pressure from the minimum to the maximum in the chamber 29, and therefore also in the chamber 36 by virtue of the communication 35.

The increase in the pressure in the chamber 36 imparts a thrust in the direction 14 to the piston 3 which will start to move down, still in the direction 14. Of course, during this phase of lowering, the chamber 36 is fed with the fluid which comes from the passage 33.

The lowering operation takes place when the resistant pressure in the chamber 4 is less than the pressure formed in the upper chamber 36. The originality of the invention is specifically the automatic nature of the establishing of the pressure in the chamber 36 independently of the position assumed by the control lever 12; as a matter of fact, by examining the intermediate stop position assumed by the lever 12 in FIG. 2, it will be noted that the situation of equilibrium of the piston 3 is established by the throttling ports 33 and 34 which are automatically regulated to create a pressure in the chamber 36 which balance the pressure of the chamber 4.

As a matter of fact, if in this position of the lever 12 the resistant force on the piston 7 increases, the piston 3 will automatically strive to rise in the direction opposite to 14, throttling the passage 34, with the consequence of increasing the pressure in the chamber 36, bringing it to a new higher value of equilibrium with the chamber 4, without it being necessary for the piston 20 and therefore the lever 12 to assume another position.

Similarly, if the resistant force on the piston 7 should for any reason decrease, the piston 3 would tend to descend in the direction 14, increasing the passage 34, with the consequence of decreasing the pressure in the chamber 36, bringing it to a new lower value of equilibrium with the chamber 4, without the piston 20 and therefore the lever 12 assuming a different position.

The displacements of the piston 3 in upward and downward directions in order to self-regulate the throttlings 33 and 34 are of micrometric order and therefore the variations in the forces do not appreciably change the positioning of the drive piston 7 established by the lever 12 and therefore of the piston 20 which remain stopped upon the variation of the forces.

While I have disclosed one embodiment of the present invention, it is to be understood that this embodiment is given by example only and not in a limiting sense.

I claim:

1. A servo-control system for the positioning of a load, comprising:

a load-driving piston reciprocable in a piston cylinder and provided with spring means tending to hold said piston in a neutral intermediate position within said chamber, said piston having a head dividing said piston cylinder into two compartments;

a servomechanism including two symmetrical pressure cylinders, a pair of plungers in said pressure cylinders defining therein two pressure chambers of variable volume, each plunger being provided with an axial bore forming a valve chamber which communicates via an internal passage in said plunger with a variable space adjacent a face of the respective plunger remote from the corresponding pressure chamber, each plunger having a solid face confronting its respective pressure chamber, each pressure chamber being provided with a discharge port communicating with a respective compartment of said piston cylinder;

a pair of valve members in said plungers having stems traversing the axial bores thereof and projecting therefrom at ends remote from said pressure chambers, each valve chamber being provided with an inlet orifice and with an outlet orifice axially separated from each other by the corresponding valve member, said internal passage terminating at a location of said valve chamber between said orifices, each valve member being axially shiftable with respect to the corresponding plunger between first and second limiting relative positions in which said internal passage is disconnected from said inlet orifice and from said outlet orifice, respectively, restricted flow paths existing between said internal passage and said orifices in intermediate relative positions of the corresponding valve members;

conduit means connecting a common supply port for high-pressure hydraulic fluid to the inlet orifices of both plungers and connecting a common discharge port for said fluid to the outlet orifices thereof;

relatively strong first biasing means urging each plunger into a withdrawn position in which the corresponding pressure chamber has its maximum volume and communicates with said discharge port;

relatively weak second biasing means urging each valve member into its first limiting relative position for cutting off the corresponding outlet port and internal passage from the corresponding inlet port; and an operating element movable in either direction from a midposition for coacting with either of said stems to displace the respective valve member against the force of said second biasing means from said first limiting relative position toward said second limiting relative position, thereby generating fluid pressure in said variable space to advance the corresponding plunger from said withdrawn position against the force of said first biasing means and closing said discharge post while reducing the volume of the associated pressure chamber with resulting buildup of fluid pressure in one of said compartments to displace said piston in a respective direction against the force of said spring means until the fluid pressure in said variable space balances the combined force of said first biasing means and said spring means, hydraulic fluid present in the other of said compartments being concurrently discharged via the pressure chamber associated with the other plunger and being replenished at low pressure from said discharge port upon subsequent reversal of the piston motion.

2. A system as defined in claim 1 wherein each valve chamber forms a throat converging toward the outlet orifice thereof, said internal passage terminating at the valve chamber upstream of said throat, each valve member having a body tapering in the direction of the outlet orifice for progressively constricting said throat upon moving toward said second limiting relative position.

3. A system as defined in claim 1 wherein said operating element is a lever swingable about a fulcrum midway between said pressure cylinders, said lever having a pair of extremities respectively engageable with said stems.

4. A system as defined in claim 1 wherein said pressure cylinders form end stops for said plungers defining the withdrawn positions thereof, both plungers engaging said end stops in the midposition of said operating element.

* * * * *